United States Patent [19]

van Mullekom

[11] 4,132,370

[45] Jan. 2, 1979

[54] DEVICE FOR FORMING A SUPPLY BOBBIN FROM A THREAD ADVANCED FROM A YARN SUPPLY

[75] Inventor: Hubert P. van Mullekom, Deurne, Netherlands

[73] Assignee: Ruti-Te Strake B.V., Deurne, Netherlands

[21] Appl. No.: 852,591

[22] Filed: Nov. 17, 1977

[30] Foreign Application Priority Data

Nov. 17, 1976 [NL] Netherlands ..... 7612811

[51] Int. Cl.[2] ..... B65H 51/20

[52] U.S. Cl. ..... 242/47.12; 66/132 R; 139/452

[58] Field of Search ..... 242/47.12, 47.13, 47.01, 242/47.02, 47.03, 47.04, 47.05, 47.06, 47.07, 47.08, 47.09, 47.1, 47.11, 82, 83; 139/452 R; 66/132 R

[56] References Cited

U.S. PATENT DOCUMENTS

| | | | |
|---|---|---|---|
| 2,387,252 | 10/1945 | Furness | 242/47.05 |
| 2,512,645 | 6/1950 | Hellbach | 242/47.12 |
| 2,581,866 | 1/1952 | Kershaw | 242/47.05 |
| 3,759,300 | 9/1973 | Pfarrwaller | 242/47.12 X |
| 3,761,031 | 9/1973 | Pfarrwaller | 242/47.01 |
| 3,776,480 | 12/1973 | Lawson | 242/47.12 X |
| 3,971,522 | 7/1976 | Pfarrwaller | 242/47.12 X |
| 3,994,447 | 11/1976 | Sarfati et al. | 242/47.12 |
| 4,028,911 | 6/1977 | Fecker et al. | 242/47.12 X |
| 4,037,802 | 7/1977 | Calamani et al. | 242/47.12 X |

FOREIGN PATENT DOCUMENTS

| | | | |
|---|---|---|---|
| 101457 | 2/1899 | Fed. Rep. of Germany | 242/47.12 |

*Primary Examiner*—Stanley N. Gilreath
*Attorney, Agent, or Firm*—Marshall & Yeasting

[57] ABSTRACT

A device for forming a supply bobbin from a thread advanced from a yarn supply includes a stationary winding drum having a winding space around the drum and defining an internal chamber and a slit connecting the winding space and the chamber. A rotatably mounted thread guide means for winding yarn on the winding space of the drum is included and a plurality of pins rotatably mounted within the chamber of the winding drum are provided for movement in an axial plane with respect to the winding drum through the slit one after the other. The pins successively exit and enter the chamber of the winding drum through the slit. Means are provided for so driving the pins continuously in a fixed transmission ratio with respect to the thread guide means that the pins exit from the chamber after a predetermined plurality of yarn windings have been formed on the winding space of the drum. The pins separate successive series of yarn windings by each momentarily forming a barrier for yarn windings.

7 Claims, 2 Drawing Figures

DEVICE FOR FORMING A SUPPLY BOBBIN FROM A THREAD ADVANCED FROM A YARN SUPPLY

BACKGROUND OF THE INVENTION

The invention relates to a device for forming a supply bobbin from a thread advanced from a yarn supply comprising a winding drum and a thread guide rotatable with respect thereto, provisions having been made to pull off this formed supply bobbin along the head of the drum.

Devices of this type form an intermediate station between the yarn supply and a yarn processing machine, such as a knitting machine, and serve to accomplish a uniform yarn pull in the direction of said yarn processing machine. The device usually operates intermittently controlled by a device detecting the yarn supply on the winding drum, e.g., in the form of a switch or a photo-electric detecting device acting on the tension of the thread windings present on the drum.

The invention aims at improving such devices for forming supply bobbins; such that predetermined thread lengths are accurately measured and delivered at accurately determined moments to the yarn processing apparatus, particularly to the weft transporting device of a shuttleless weaving machine.

This aim is achieved according to the invention by having the winding drum cooperate with a plurality of pins which are movable in an axial plane with respect to the winding drum and which are driven in a fixed transmission ratio to the movable part of the winding drum-thread guide assembly. The pins enter through a recess from a chamber within the drum into a winding space around the drum and leave said space through the recess after a displacement in the axial direction. At the moment in which a pin enters the winding space, the number of thread windings, which are present in front of that pin on the winding drum, is confined while behind it a thread bobbin determining the next thread length to be measured is built up until the next pin enters the winding space and also this second number of thread windings is completed and so on. Thereby the measured number of thread windings between two successive pins remains confined until the foremost of both pins leaves the winding space at which moment the yarn length which is lying ready may be pulled off, e.g., under the influence of the force imparted thereto by the blowing nozzle of a pneumatic weft transporting device of a weaving machine.

As compared with other yarn preparation devices as applied to shuttleless weaving machines, in which in addition to continuously rotating measuring rolls an intermittently operating yarn buffering device and a yarn clamp becoming operative at the end of the weft phase are applied, the device according to the invention offers the advantage that no special yarn clamp is necessary since the foremost of the pins confining the next series of thread windings functions as such. The series of thread windings determining the next weft may yield somewhat and thereby bring about a certain damping whereby the tension peak occurring by the stopping of the weft remains lower. This yarn stopping function, which as it were is built in the yarn preparation device is at the same time suitable for multiple application in a colour shifting system.

In the yarn preparation device according to the invention it is of course important that the pins each time accomplish a separation between the correct two successive thread windings. One may be assured thereof if in addition means are provided which bring about a uniform axial transport of the thread windings layed onto the winding drum by the thread guide. A winding drum structure may be used having radially and axially movable transport ridges according to U.S. Pat. No. 3,776,480, issued Dec. 4, 1973 in the name of John B. Lawson. With such a winding drum structure, the successive thread windings moreover are layed with an ample mutual spacing whereby the pins with certainty become operative between the correct two thread windings.

A structurally simple and preferably applied embodiment is that in which the thread guide delivers the yarn to the end face of a collar on the winding drum which gradually merges with the winding surface of the drum and in which the pins enter into the winding space at the end face of the collar. With this embodiment, the pins enter the winding space directly with their maximum radial insert height so that no provisions need be made for uniformiy closing the formed thread windings. Said thread windings may simply be closed by the pins displacing in axial direction in the winding space.

According to a further feature of the invention, the pins are mounted on a disk rotatable in an axial plane within the drum chamber such that when the disk is rotated they carry out a translation movement and are always directed substantially radially with respect to the winding drum. Thereby the radial velocity or velocity component by which the pins leave the winding space is maximum which considerably decreases the dispersion in the moment in which a formed supply bobbin is released, with respect to a structure in which the pins would have a fixed radial position with respect to the disk.

Other objects and advantages of the invention will become apparent from the following detailed description, with reference being made to the accompanying drawings.

DESCRIPTION OF THE PREFERRED EMBODIMENT

Figure 1:
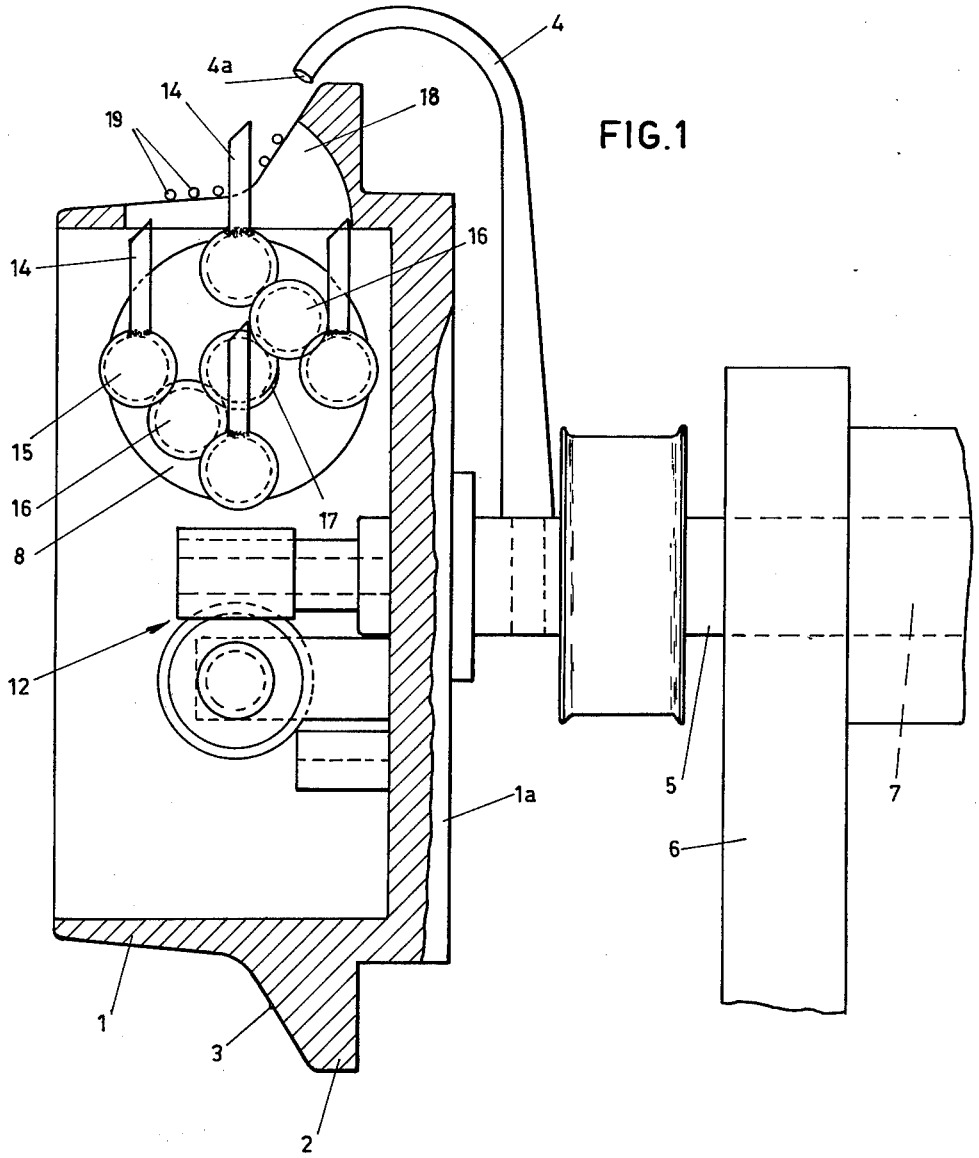
FIG. 1 shows partially in side view and partially in axial section the device according to the invention and FIG. 2 is an end view as seen from the left in FIG. 1.
Figure 2:
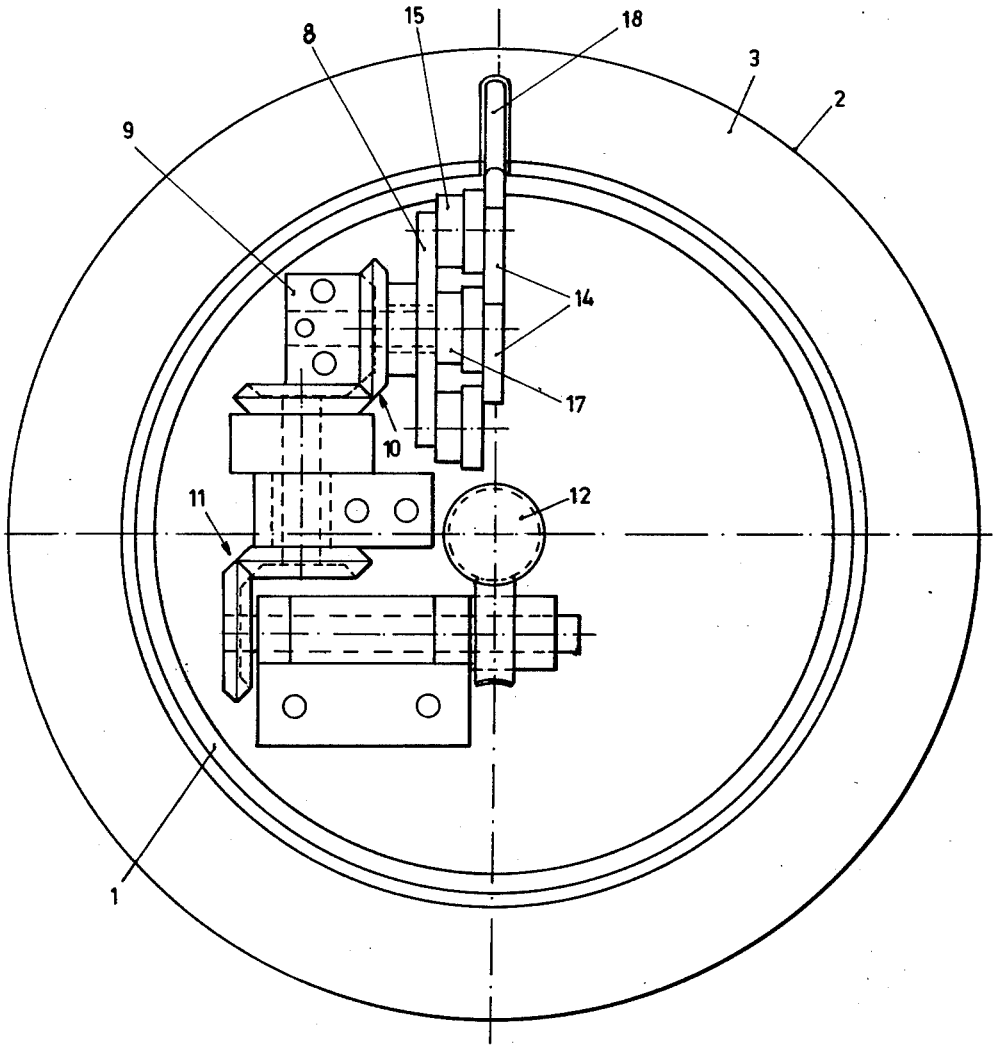

The device shown in the drawings comprises a stationary winding drum 1 having a collar 2, the flank 3 of which merges obliquely with the shell surface of the drum 1. A thread guide or winding arm 4 cooperates with the drum 1 which is secured to a shaft 5 rotatably mounted in supporting bearings, not shown, in the end wall 1a of the winding drum 1 and in a frame 6.

The winding arm 4 provided with a guiding channel is situated with its thread exit end 4a adjacent to the flank 3 of the collar. The yarn is supplied through a bore 7 in the shaft 5 from a yarn packet not shown to the winding arm 4.

Within the chamber enclosed by the winding drum 1 there is a disk 8 which is rotatably mounted on an axis perpendicular to that of the drum 1 in a bearing support 9 secured within the drum. The disk 8 is driven by the shaft 5 through the intermediary of two right angle gear transmissions 10 and 11 and a worm wheel transmission 12. There is a fixed ratio between the velocity of the winding arm 4 and that of the disk 8.

The disk 8 carries four pins 14 provided equally spaced along its circumference which pins extend radially from pinions 15 rotatably provided on the disk 8. The pinions are in engagement via intermediate gears 16 with a central pinion 17 which is secured to the disk, the arrangement being such that the pins 14 describe a translation movement when the disk 8 is rotated. The pins 14 thereby take a radial position with respect to the drum 1 and exit during operation, that is, when the winding arm 4 and the disk 8 are rotating, successively through a recess 18 in the wall and the collar of the winding drum into the winding space around the winding drum and in front of the collar 2, whereafter after a certain axial displacement they again enter the chamber within the winding drum.

The drawing show the device at the moment in which the upper end of the pin 14 situated farthest to the left has just left the winding space around the drum 1 so that the thread windings indicated at 19, which together form a predetermined thread length, are released so that they may be pulled off in the direction of the yarn processing machine. A the same moment to the right of the pin 14 in the top position already a number of the thread windings determining the next predetermined thread length have formed which slide off the exit end 4*a* of the winding arm 4 along the oblique flank 3 toward the plane of the drum shell. It is easily recognized that with a further counter clockwise rotation of the disk 8 the pin 14 situated at the extreme right at the flank 3 in the winding space will enter in front of the collar 2 and thereby form a closure behind the thread windings having formed in that moment.

In that the pins 14 enter into and exit from the winding space around the winding drum in radial direction, the establishment of a separation between two successive series of thread windings and also the removal of the barrier for pulling off each time the foremost series of thread windings take place with the greatest possible velocity which keeps the dispersion of the moment in which the pulling off of the yarn takes place very small.

Instead of four pins as applied in the described embodiment also three pins could suffice while also more than four pins could be applied.

It is to be understood that the above description is illustrative of this invention and that various modifications thereof can be utilized without departing from its spirit and scope.

I claim:

1. A device for forming a supply bobbin from a thread advanced from a yarn supply comprising, in combination, a stationary winding drum having a winding space around the drum and defining an internal chamber and a slit connecting the winding space and the chamber, rotatably mounted thread guide means for winding yarn on the winding space of the drum, a plurality of pins rotatably mounted within the chamber of the winding drum for movement in an axial plane with respect to the winding drum through the slit one after the other, the pins successively exiting and entering the chamber of the winding drum through the slit, and means for so driving the pins continuously in a fixed transmission ratio with respect to the thread guide means that the pins exit from the chamber after a predetermined plurality of yarn windings have been formed on the winding space of the drum, the pins separating successive series of yarn windings by each momentarily forming a barrier for yarn windings.

2. A device according to claim 1 wherein the winding space around the drum includes a winding surface and a collar having an end face which gradually merges with the winding surface and in which the pins enter the winding space at the end face of the collar.

3. A device according to claim 2 wherein the thread guide means delivers the yarn to the end face of the collar.

4. A device according to claim 2 wherein the pins are mounted on a disk which is rotatable in an axial plane within the chamber of the winding drum.

5. A device according to claim 3 wherein the pins are mounted on a disk which is rotatable in an axial plane within the chamber of the winding drum.

6. A device according to claim 4 wherein the pins are so mounted movably on the disk and driven that they carry out a translational movement with the rotation of the disk and are always directed substantially radial with respect to the winding drum.

7. A device according to claim 5 wherein the pins are so mounted movably on the disk and driven that they carry out a translational movement with the rotation of the disk and are always directed substantially radial with respect to the winding drum.

* * * * *